US005810610A

United States Patent [19]

Kobayashi et al.

[11] Patent Number: 5,810,610

[45] **Date of Patent: *Sep. 22, 1998**

[54] DEVICE FOR CONNECTING A CABLE, IN PARTICULAR A HIGH-VOLTAGE CABLE FOR AN INTERNAL COMBUSTION ENGINE

[75] Inventors: Yoshinao Kobayashi; Yuji Watanabe, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 693,910

[22] Filed: Aug. 5, 1996

[30] Foreign Application Priority Data

Aug. 8, 1995 [JP] Japan ..... 7-202227
Aug. 8, 1995 [JP] Japan ..... 7-202228

[51] Int. Cl.[6] ..... H01R 13/573

[52] U.S. Cl. ..... 439/125; 439/127; 439/350; 439/846

[58] Field of Search ..... 439/125–128, 439/349, 350, 846

[56] References Cited

U.S. PATENT DOCUMENTS

| | | | |
|---|---|---|---|
| 2,659,876 | 11/1953 | Dupre et al. | 439/846 |
| 2,699,535 | 1/1955 | Flora . | |
| 3,109,691 | 11/1963 | Burkhardt | 439/125 |
| 3,364,459 | 1/1968 | Schiller . | |
| 4,009,924 | 3/1977 | Bungo et al. . | |
| 4,037,914 | 7/1977 | Fetzer . | |
| 4,193,651 | 3/1980 | Hays | 439/125 |
| 4,269,472 | 5/1981 | Shaffer et al. | 439/846 |
| 4,493,520 | 1/1985 | Davies | 439/350 |
| 4,880,389 | 11/1989 | Mochizuki et al. | 439/125 |
| 5,221,213 | 6/1993 | Lee | 439/125 |
| 5,276,752 | 1/1994 | Gugelmeyer et al. | 385/69 |

FOREIGN PATENT DOCUMENTS

| | | |
|---|---|---|
| 0 637 856 | 2/1995 | European Pat. Off. . |
| 2151953 | 4/1973 | France . |
| 2 696 505 | 4/1994 | France . |
| 41 13 473 | 10/1992 | Germany . |
| 55-27981 | 7/1980 | Japan . |
| 58-80283 | 5/1983 | Japan . |
| 1024938 | 4/1966 | United Kingdom . |
| 1502837 | 3/1978 | United Kingdom . |

*Primary Examiner*—J. J. Swann
*Attorney, Agent, or Firm*—Anthony J. Casella; Gerald E. Hespos; Ludomir A. Budzyn

[57] ABSTRACT

To realize a simple and inexpensive connection of a high-voltage resistive cable and a high-voltage part without providing a special facility. A C-shaped fittable member 11 the opposite ends of which have inwardly acting restoring forces is provided. A groove 13 is formed on the outer surface of a right end portion of a connection part 2. Rectangular through holes are formed in a part insertion portion 1a fitted with the connection part 2 in two positions facing the groove 13. The fittable member 11 is cut in positions in the vicinity of the opposite ends thereof. The left sides of cut portions are bent inward to form projections 16a, 16b. By fitting the fittable member 11 on the part insertion portion 1a, the projections 16a are fitted and locked in the groove 13 through the through holes of the part insertion portion 1a so as to prevent the connection part 2 from coming out of the part insertion portion 1a.

7 Claims, 7 Drawing Sheets

DEVICE FOR CONNECTING A CABLE, IN PARTICULAR A HIGH-VOLTAGE CABLE FOR AN INTERNAL COMBUSTION ENGINE

BACKGROUND OF THE INVENTION

1. Field of the Invention

The present invention relates to a device for connecting a cable, in particular a high-voltage resistive cable used for an internal combustion engine with a high-voltage part.

2. Description of the Prior Art

A high voltage is supplied to a spark plug provided in each cylinder of an automotive engine from a spark coil for generating a high voltage via a high-voltage resistive cable. There are two supply methods: a central coil system for supplying voltages to the respective spark plugs from a single spark coil via a distributor, and a direct coil system for directly supplying voltages to the respective spark plugs from spark coils provided as many as the spark plugs. High-voltage resistive cables are used for the electrical connection of the distributor with the spark plugs in the central coil system and for the electrical connection of the spark coils with the spark plugs in the direct coil system. A specific prior art connection of the high-voltage resistive cable with a high-voltage part such as a distributor, a spark coil or a spark plug is made, for example, using a terminal main body 1 made of, e.g. a metal and a connection part 2 as shown in FIG. 16.

The terminal main body 1 is well-known as disclosed in Japanese Examined Utility Model Publication No. 55-27981 and is constructed, for example, as shown in FIG. 17. The terminal main body 1 includes a part insertion portion 1*a* at its left side and a cable retainer 1*b* at its middle and right sides. The cable retainer 1*b* retains an end of a high-voltage resistive cable while establishing an electrical connection therewith. After the connection part 2 is inserted into the part insertion portion 1*a,* a pin 4 is inserted into through holes formed in the terminal main body 1 and the connection part 2 as shown in FIG. 16 so as to fix the connection part 2 inserted into the part insertion portion 1*a*. Identified by 5 in FIG. 17 is the through hole into which the pin 4 is inserted.

On the other hand, the connection part 2 is constructed as shown in FIGS. 18 to 22. As shown in FIG. 20, in the left end surface of a part main body 2*a* substantially in the form of a circular column, there is formed an insertion hole 2*b* as a female terminal portion into which a male terminal portion formed at the high-voltage part (not shown) such as a distributor is inserted. A groove 2*c* is formed in the outer surface of one end portion of the part main body 2*a* as shown in FIGS. 18 and 20, and a part of the part main body 2*a* in the groove 2*c* is cut away as shown in FIG. 21, thereby forming a notch 2*d.* A connection pin 7 as shown in FIG. 22 as a holding member which is made by folding a music wire or the like into a D-shape and has a spring property is fitted into the groove 2*c* and the notch 2*d* as shown in FIG. 19. The connection pin 7 may be shaped such that a curved portion of the D-shape is cut.

The substantially linear portion of the connection pin 7 is fitted in the notch 2*d* as shown in FIG. 19 and comes into contact with the male terminal portion of the high-voltage part inserted into the insertion hole 2*b.* As a result, the male terminal portion can be securely held in the insertion hole 2*b,* thereby securely maintaining an electrical connection between the high-voltage part and the connection part 2.

As shown in FIG. 18, a through hole 2*e* is formed in a right or front end portion of the connection part 2. After the connection part 2 is inserted into the part insertion portion 1*a* such that the through hole 2*e* at least partially communicates with the through hole 5 of the part insertion portion 1*a* of the terminal main body 1, the pin 4 is inserted into the through holes 5, 2*e,* securing the terminal main body 1 and the connection part 2.

In the case that the high-voltage resistive cable is retained by the cable retainer 1*b,* in order to ensure a more secure electrical connection, the cable retainer 1*b* is fastened to an insulation coating of the cable with a core of the cable exposed by peeling folded back along the insulation coating.

However, according the prior art method described above, the through holes 5, 2*e* into which the pin 4 is inserted need to be processed in precise positions of the terminal main body 1 and the connection part 2 since the terminal main body 1 and the connection part 2 are secured by the pin 4. This processing is very cumbersome and has a poor operability. Further, since a special facility, i.e. an apparatus for processing the through holes 5, 2*e* and an apparatus for fitting the pin 4, is necessary, a production cost is high.

An object of the invention is to realize a simple and inexpensive connection of a cable, particularly a high-voltage resistive cable and a high-voltage part without providing a special facility.

SUMMARY OF THE INVENTION

According to the invention, there is provided a connection device for connecting a cable, in particular a high-voltage resistive cable used for an internal combustion engine with a high-voltage part, wherein an electrical connection means at least partially insertable or fittable into a part insertion portion formed in a terminal main body, and a fittable member is fitted on or in the part insertion portion such that at least one projection formed on the fittable member is fitted and/or locked in a locking means formed in or on the electrical connecting means, thereby preventing the electrical connecting means from coming out of the part insertion portion.

According to a preferred embodiment of the invention, the projection is fitted and/or locked in a locking means through at least one through hole formed in the part insertion portion.

Preferably, the terminal main body is formed with a cable retainer for retaining an end of a cable, in particular a high-voltage resistive cable while establishing an electrical connection.

Further preferably, the electrical connecting means comprises a connection part fittable with a terminal portion, particularly a male terminal portion of a voltage part, in particular a high-voltage part.

Still further preferably, a female terminal portion is formed at one end surface of the connection part and the male terminal portion is insertable into the female portion.

According to a further preferred embodiment of the invention, the locking means comprises a groove formed on the electrical connection means, in particular on the outer surface of the connection part and wherein the fittable member is fitted and/or locked in the groove.

Preferably, the electrical connecting means is formed by a terminal portion, particularly a male terminal portion, of a voltage part, in particular high-voltage part.

Further preferably, the projection is so formed as to be lockable or fittable in an external thread formed on the male terminal portion, in particular in a groove of the external thread.

Still further preferably, the fittable member is a C-shaped fittable member, the opposite ends of which have inwardly acting restoring forces.

According to a still further preferred embodiment, the engagement of the male terminal portion with the female terminal portion is held by a holding member.

Preferably, the electrical connection means comprises a terminal portion, particularly a male terminal portion having a thread and wherein at least one of the projections is in contact with the ridge of the external thread of the terminal portion.

Further preferably, the fittable member comprises one or more inwardly projecting tongue-shaped projections.

Most preferably, the projections are formed such that their ridges are inclined at substantially the same angle as an angle or angles of inclination of a groove of a external thread of the male terminal portion.

The invention further provides a use of an inventive connection device for connecting a high-voltage resistive cable of an internal combustion engine with a high-voltage part.

According to a preferred embodiment of the invention, there is provided a connection device for connecting a high-voltage resistive cable used for an internal combustion engine with a high-voltage part, wherein:

an end of the high-voltage resistive cable is retained by a cable retainer of a terminal main body, a connection part fitted with a male terminal portion of the high-voltage part is inserted into a part insertion portion formed in the terminal main body, and a fittable member is fitted on the part insertion portion such that a projection formed on the fittable member is fitted and locked in a groove formed on the outer surface of the connection part through a through hole formed in the part insertion portion, thereby preventing the connection part from coming out of the part insertion portion.

Accordingly, only by fitting the fittable member on the part insertion portion, the connection part can be secured to the terminal main body while being prevented from coming out of the part insertion portion of the terminal main body. Thus, unlike the prior art in which a pin is adopted to secure these elements, a special facility is not necessary, and the high-voltage resistive cable and the high-voltage part can be easily connected at a reduced cost.

As described above, only by fitting the fittable member on the part insertion portion of the terminal main body, the connection part can be secured to the terminal main body while being prevented from coming out of the part insertion portion. Accordingly, unlike the prior art in which a pin is adopted to secure these elements, a high processing precision and a special facility are not necessary. Thus, the high-voltage resistive cable and the high-voltage part can be easily connected at a reduced cost.

According to a further preferred embodiment of the invention, there is provided a connection device for connecting a high-voltage resistive cable used for an internal combustion engine, comprising:

a terminal main body formed at one end thereof with a part insertion portion and at the other end thereof with a cable retainer for retaining an end of the high-voltage resistive cable while establishing an electrical connection, a male terminal portion formed at a connection portion of the high-voltage part, a connection part inserted into the part insertion portion, a female terminal portion which is formed at one end surface of the connection part and into which the male terminal portion is inserted, a C-shaped fittable member the opposite ends of which have inwardly acting restoring forces and which is to be fitted on the part insertion portion, a groove formed on the outer surface of the other end of the connection part, and a projection formed on the fittable member to be fitted and locked in the groove through a through hole formed in the part insertion portion so as to prevent the connection part from coming out of the part insertion portion.

By fitting the C-shaped fittable member on the part insertion portion of the terminal main body, the projection formed on the fittable member is fitted into the groove of the connection part through the through hole formed in the part insertion portion, and is strongly locked therein by the restoring forces of the opposite ends of the fittable member, preventing the connection part from coming out of the part insertion portion. As a result, the connection part can be secured to the terminal main body. Accordingly, unlike the prior art in which a pin is adopted to secure these elements, a special facility is not necessary, and the high-voltage resistive cable and the high-voltage part can be easily connected at a reduced cost. Particularly, if the fittable member is C-shaped and the projections are strongly locked in the groove by the restoring forces of the opposite ends of the C-shaped fittable member, the connection part can be more securely fixed to the terminal main body.

If the high-voltage part is a distributor, a spark coil or a spark plug, it is effective.

Further, if the cable retainer retains an insulation coating of the high-voltage resistive cable with a core of the high-voltage resistive cable exposed by peeling folded back along the insulation coating, the end of the high-voltage resistive cable can be retained while an electrical connection is securely maintained.

The male terminal portion may be formed with an external thread.

If the engagement of the male terminal portion with the female terminal portion is held by a holding member, an electrical connection between the high-voltage part and the connection part can be securely maintained.

If a plurality of through holes are formed in the part insertion portion and a plurality of projections are formed on the fittable member, the connection part can be securely fixed to the terminal main body.

According to a further preferred embodiment of the invention, there is provided a connection device for connecting a high-voltage resistive cable used for an internal combustion engine with a high-voltage part, wherein:

an end of the high-voltage resistive cable is retained by a cable retainer of a terminal main body, a male terminal portion, formed with an external thread, of the high-voltage part is fitted into a part insertion portion of the terminal main body, and a fittable member is fitted on the part insertion portion such that a projection formed on the fittable member is locked in a groove of the external thread of the male terminal portion through a through hole formed in the part insertion portion, thereby preventing the male terminal portion from coming out of the part insertion portion.

Only by fitting the fittable member on the part insertion portion of the terminal main body, the male terminal portion of the high-voltage part is prevented from coming out of the part insertion portion, thereby securing the high-voltage part to the terminal main body. Accordingly, a connection part and a special facility which are necessary for the prior art in which a pin is adopted to secure the elements are not required. Thus, the high-voltage resistive cable and the high-voltage part can be easily connected at a reduced cost.

As described above, only by fitting the fittable member on the part insertion portion of the terminal main body, the male terminal portion of the high-voltage part is prevented from coming out of the part insertion portion, thereby securing the high-voltage part to the terminal main body. Accordingly, a connection part and a special facility which are necessary for the prior art in which a pin is adopted to secure the elements are not required, and the number of parts can be reduced. Thus, the high-voltage resistive cable and the high-voltage part can be easily connected at a reduced cost.

If the projection is so formed as to be fittable into the groove of the external thread of the male terminal portion, it can be more securely locked in the groove of the male terminal portion. As a result, the reliability of the connection device improves.

Further according to a preferred embodiment of the invention, there is provided a connection device for connecting a high-voltage resistive cable used for an internal combustion engine, comprising:

a terminal main body formed at one end thereof with a part insertion portion and at the other end thereof with a cable retainer for retaining an end of the high-voltage resistive cable while establishing an electrical connection, a male terminal portion formed with an external thread at a connection portion of the high-voltage part, a C-shaped fittable member the opposite ends of which have inwardly acting restoring forces and which is to be fitted on the part insertion portion, a through hole formed in the part insertion portion of the terminal main body, and a projection which is so formed on the fittable member as to be fittable into a groove of the external thread of the male terminal portion, is fitted and locked in the groove of the external thread of the male terminal portion through the through hole, thereby preventing the male terminal portion from coming out of the part insertion portion.

By fitting the C-shaped fittable member on the part insertion portion of the terminal main body, the projection formed on the fittable member is fitted into the groove of the external thread of the male terminal portion through the through hole formed in the part insertion portion and is strongly locked in the groove by the restoring forces of the opposite ends of the fittable member. As a result, the male terminal portion of the high-voltage part is prevented from coming out of the part insertion portion and, therefore, the high-voltage part can be secured to the terminal main body. Accordingly, a connection part and a special facility which are necessary for the prior art in which a pin is adopted to secure the elements are not required. Thus, the high-voltage resistive cable and the high-voltage part can be easily connected at a reduced cost.

In other words, since the projection can be strongly locked in the groove by the restoring forces of the opposite ends of the C-shaped fittable member, the high-voltage resistive cable and the high-voltage part can be easily and securely connected at a reduced cost.

Further, at least one of the projections may be in contact with a ridge of the external thread of the male terminal portion.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENTS

Figure 1:
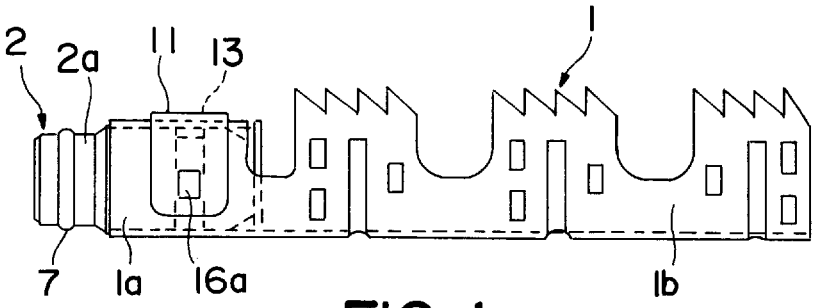
FIGS. 1 and 2 are front and plan views of one embodiment of the invention, respectively.
Figure 2:
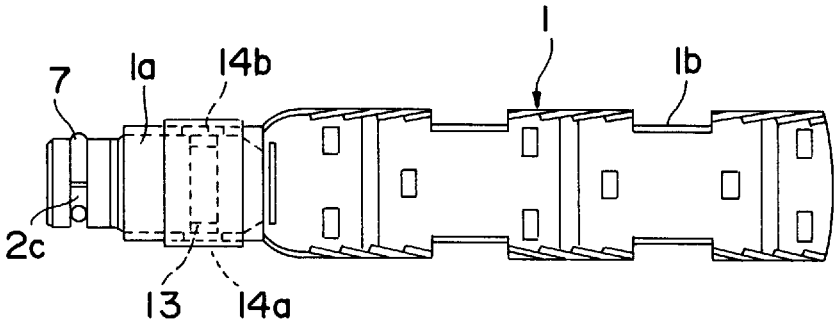
Figure 3:
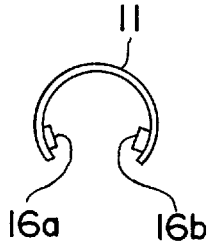
FIGS. 3, 4 and 5 are side, front and bottom views of a part of the embodiment, respectively.
Figure 4:
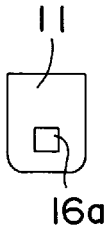
Figure 5:
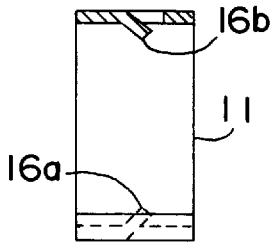

In these the FIGS. 1 to 15, elements identical or corresponding to those in FIGS. 16 to 22 are identified by the same reference numerals. Hereafter, the elements already described with reference to FIGS. 16 to 22 are not described in order to avoid repetition, and only different points are described.

Figure 16:
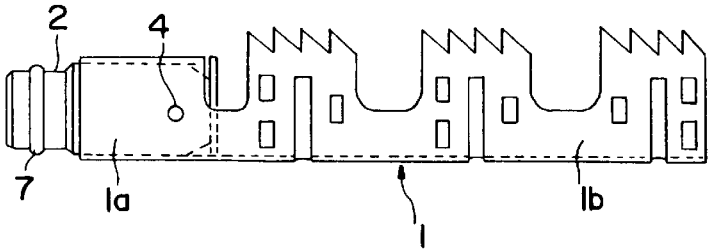
FIG. 16 PRIOR ART
FIG. 16 is a front view of a prior art.
Figure 17:
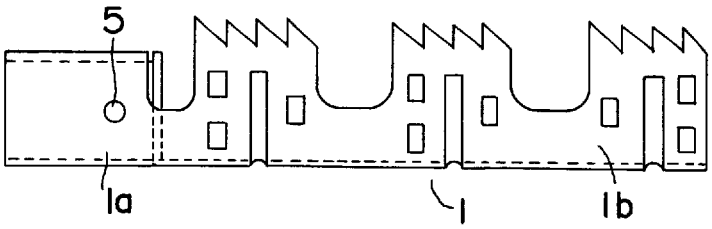
FIG. 17 PRIOR ART
FIG. 17 is a front view of a terminal main body of the prior art.
Figure 18:
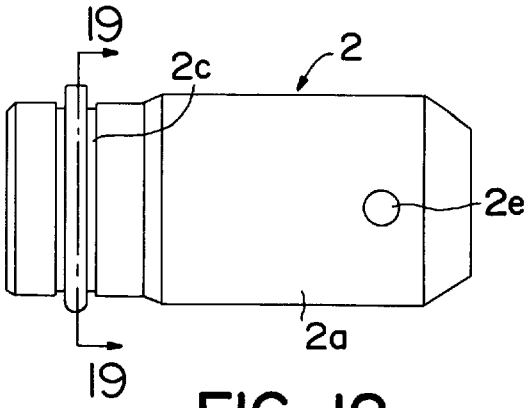
FIG. 18 PRIOR ART
FIG. 18 is a front view of a connection part of the prior art.
Figure 19:
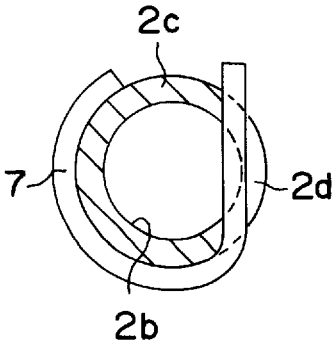
FIG. 19 PRIOR ART
FIG. 19 is a section along 19—19 of FIG. 18.
Figure 20:
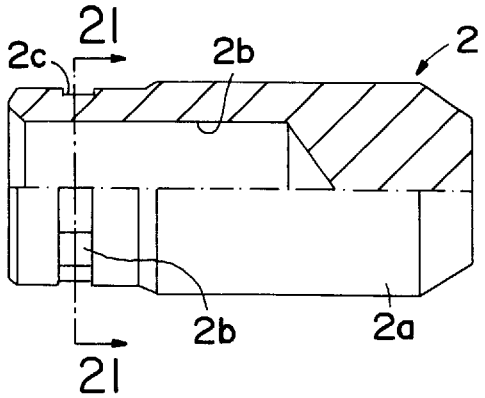
FIG. 20 PRIOR ART
FIG. 20 is a section of a part of FIG. 18.
Figure 21:
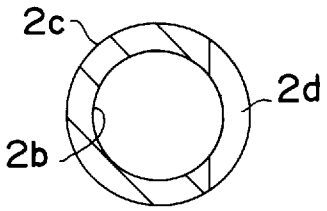
FIG. 21 PRIOR ART
FIG. 21 is a section along 21—21 of FIG. 20.
Figure 22:
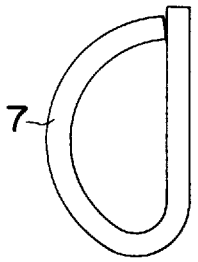
FIG. 22 PRIOR ART
FIG. 22 is a side view of a connection pin (retaining member) of the prior art.

Instead of the pin 4 and the through holes 5, 2*e* shown in FIGS. 16 to 18, the following arrangement is adopted in this embodiment. A C-shaped fittable member 11 which is made of e.g. stainless steel and the opposite ends of which have inwardly acting restoring forces is provided. A groove 13 is formed in the outer surface of a right end portion of a connection part 2. A part insertion portion 1*a* fitted with the connection part 2 is formed with substantially rectangular through holes 14*a*, 14*b* in two positions facing at least partially the groove 13. Tongue-shaped projections 16*a*, 16*b* are formed by cutting the fittable member 11 in positions in the vicinity of the opposite ends thereof and bending the left ends of cut portions inward. By fitting the fittable member 11 on the part insertion portion 1*a*, the projections 16*a*, 16*b* are fitted in the groove 13 through the through holes 14*a*,

14*b,* respectively and locked therein, thereby preventing the connection part 2 from coming out of the part insertion portion 1*a*.

At this time, only by fitting the C-shaped fittable member 11 on the part insertion portion 1*a* of the terminal main body 1, the projections 16*a,* 16*b* of the fittable member 11 are fitted into the groove 13 of the connection part 2 through the through holes 14*a,* 14*b* of the part insertion portion 1*a*. The projections 16*a,* 16*b* are strongly locked in the groove 13 by the restoring forces of the opposite ends of the fittable member 11, thereby preventing the part insertion portion 1*a* from coming out of the connection part 2. In this way, the connection part 2 can be secured to the terminal main body 1. Even if the connection part 2 is inserted into the part insertion portion 1*a* after the fittable member 11 is fitted on the part insertion portion 1*a,* the connection part 2 can be similarly secured to the terminal main body 1.

Accordingly, unlike the prior art in which a pin is adopted to secure the elements, this embodiment does not require a special facility. It is sufficient to process the groove 13 in the connection part 2 and the through holes 14*a,* 14*b* in the part insertion portion 1*a*. Such processing does not require a high precision which is necessary to form the prior art holes 5, 2*e*. Thus, the high-voltage resistive cable and the high-voltage part can be easily connected at a reduced cost.

Since the cable retainer 1*b* is fastened to the insulation coating after the cores of the high-voltage resistive cable exposed by peeling are folded back along the insulation coating, the electrical connection between the high-voltage resistive cable and the terminal main body 1 can be securely maintained.

Further, since the linear portion of a connection pin 7 as a holding member is fitted into a notch 2*d* to contact the male terminal portion of the high-voltage part inserted into an insertion hole 2*b* and the male terminal portion of the high-voltage part is held in the insertion hole 2*b* by the connection pin 7 (see FIG. 10), the electrical connection between the high-voltage part and the connection part 2 can be securely maintained.

Here, the high-voltage part refers to a distributor, a spark coil or a spark plug.

Even if the male terminal portion of the high-voltage part is formed with an external thread, the electrical connection between the high-voltage part and the connection part 2 can be securely maintained by the connection pin 7.

Figure 6:
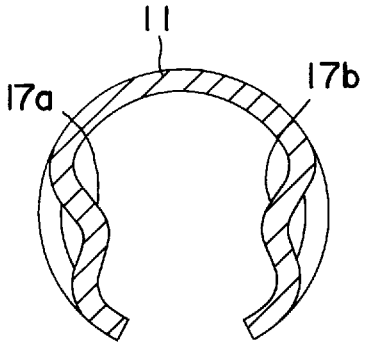
FIG. 6 is a side section of a part of another embodiment of the invention.
Figure 7:
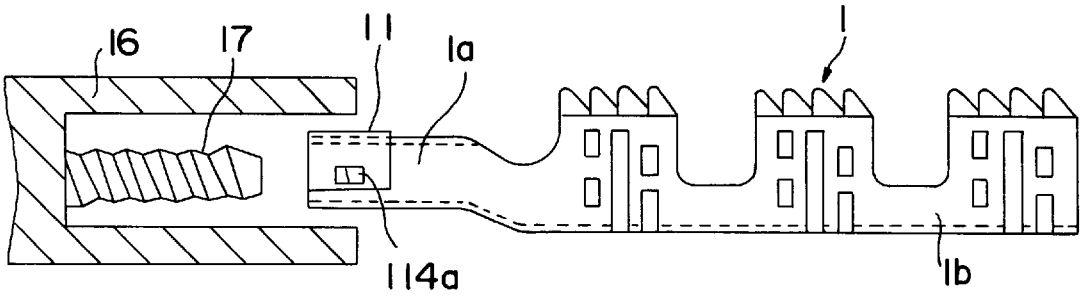
FIG. 7 is a front view of a further embodiment of the invention.
Figure 8:
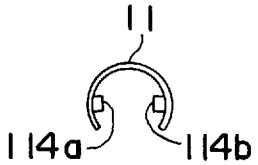
FIG. 8 is a side view of a part of the embodiment.
Figure 9:
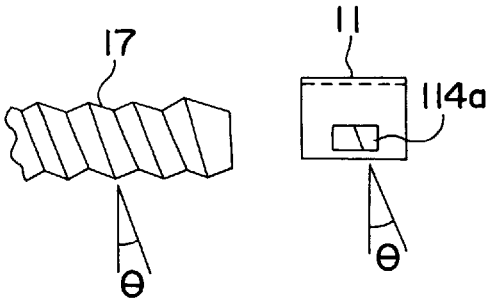
FIG. 9 is a diagram showing how the embodiment operates.
Figure 10:
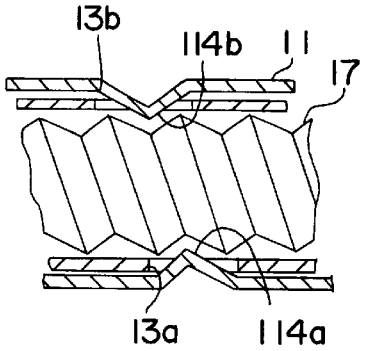
FIG. 10 is an enlarged front view partly in section of a part of the embodiment.

As another embodiment, instead of the tongue-shaped projections 16*a,* 16*b,* the fittable member 11 may be deformed in positions in the vicinity of its opposite ends so as to project inward, thereby forming projections 17*a,* 17*b* as shown in FIG. 6. The shape of the projections are not limited to those, but may be such that can be fitted and locked in the groove 13 of the part insertion portion 1*a*.

By forming three or more holes in the part insertion portion 1*a* and three or more projections on the fittable member 11, the connection part 2 can be more securely fixed to the terminal main body 1.

Further, a single hole and a signal projection may be formed in the part insertion portion 1*a* and on the fittable member 11, respectively.

Next further embodiments of the invention will be described with reference to FIGS. 7 to 15.

Instead of the pin 4 and the through holes 5, 2*e* shown in FIGS. 16 to 18, the following arrangement is adopted in this embodiment. A C-shaped fittable member 11 which is made e.g. stainless steel and the opposite ends of which have inwardly acting restoring forces is provided. Rectangular through holes 13*a,* 13*b* larger than projections to be described later are formed in a part insertion portion 1*a* in two substantially opposing positions. The fittable member 11 is so formed or deformed as to project inward in positions in the vicinity of the opposite ends thereof, thereby forming projections 114*a,* 114*b*. By fitting the fittable member 11 on the part insertion portion 1*a,* the projections 114*a,* 114*b* are fitted and locked in the root of an external thread of a male terminal portion 17 of a high-voltage part through the holes 13*a,* 13*b,* thereby preventing the part insertion portion 1*a* from coming out of the high-voltage part 16.

At this time, the projections 114*a,* 114*b* are formed such that their ridges or surfaces are inclined at substantially the same angle as an angle of inclination θ of the groove of the external thread of the male terminal portion 17. Further, the projections 114*a,* 114*b* are shifted by a specified distance so as to be both fitted in the groove of the external thread of the male terminal portion 17.

Only by fitting the C-shaped fittable member 11 on the part insertion portion 1*a* of the terminal main body 1, the projections 114*a,* 114*b* of the fittable member 11 are fitted in the groove of the external thread of the male terminal portion 17 of the high-voltage part 16 through the holes 13*a,* 13*b* of the part insertion portion 1*a,* and are strongly locked in the external thread by the restoring forces of the opposite ends of the fittable member 11. As result, the high-voltage part 16 is prevented from coming out of the part insertion portion 1*a*. In this way, the high-voltage part 16 can be secured to the terminal main body 1. It should be appreciated that the high-voltage part 16 can be secured to the terminal main body 1 even if the high-voltage part 16 is inserted after the fittable member is fitted on the part insertion portion 1*a*.

Figure 11:
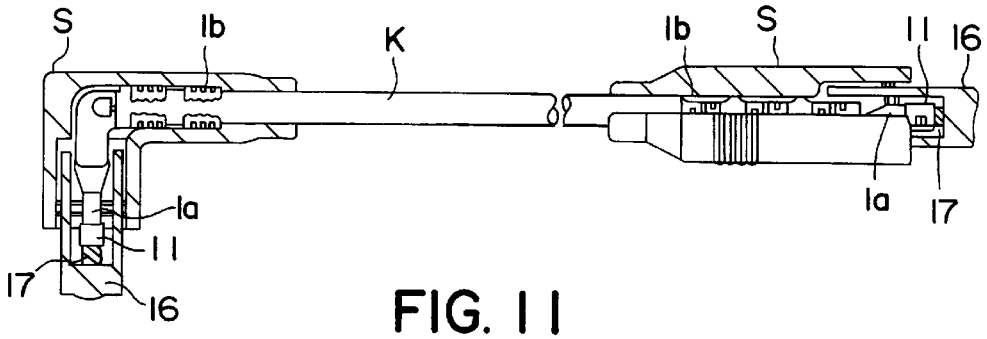
FIG. 11 is a diagram partly in section of the embodiment in use.

More specifically, such a connection device for the high-voltage resistive cable is used for a so-called center code type, plug code type or the like as shown in FIG. 11. In FIG. 11, identified by K is a high-voltage resistive cable the opposite ends of which are retained by cable retainers 1*b* of the terminal main bodies 1. The male terminal portion 17 of a spark coil as the high-voltage part 16 is secured to the part insertion portion 1*a* of the terminal main body 1 at the left side of FIG. 11 by the fittable member 11. The male terminal portion 17 of a distributor as the high-voltage part 16 is secured to the part insertion portion 1*a* of the terminal main body 1 at the right side of FIG. 11 by the fittable member 11. Rubber members S made of, e.g. ethylene-propene-diene-monomer (EPDM) are so mounted as to cover both terminal main bodies 1.

According to the foregoing embodiment, the high-voltage part 16 can be secured to the terminal main body 1 only by fitting the fittable member 11 on the part insertion portion 1*a* of the terminal main body 1. Accordingly, a connection part and a special facility which are necessary for the prior art in which a pin is adopted to secure the elements are not required. Thus, the high-voltage resistive cable and the high-voltage part can be easily connected at a reduced cost.

Further, by fastening the cable retainer 1*b* to an insulation coating of the high-voltage resistive cable with a core thereof exposed by peeling folded back along the insulation coating, an electrical connection between the resistive cable and the terminal main body 1 can be securely maintained.

Here, the high-voltage part refers to a distributor, a spark coil or a spark plug.

Figure 12:
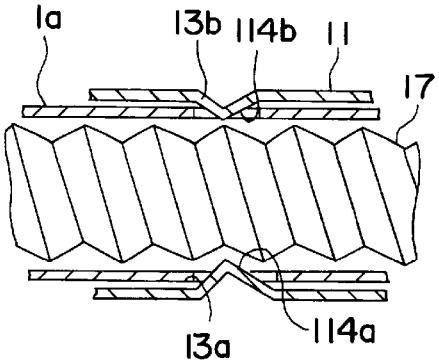
FIG. 12 is an enlarged front view partly in section of a part of still a further embodiment of the invention.

As another embodiment, one projection 14*b* may be so formed as to come into contact with the ridge of the external thread of the male terminal portion 17 as shown in FIG. 12.

In this case as well, the same effect as in the case of FIGS. 7 to 11 can be obtained.

Figure 13:
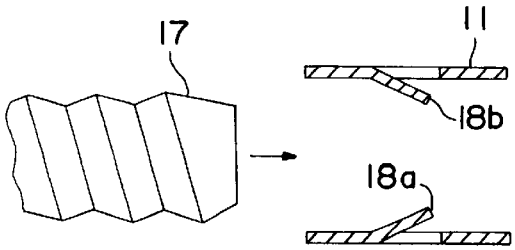
FIG. 13 is an enlarged front view partly in section of a part of still another embodiment of the invention.
Figure 14:
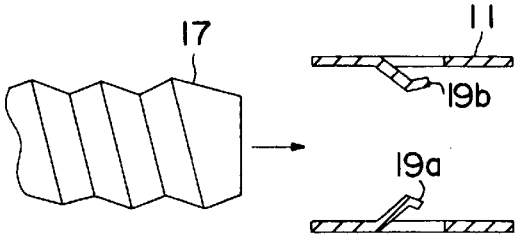
FIG. 14 is an enlarged front view partly in section of a part of further another embodiment of the invention.

Further, as shown in FIG. 13, tongue-shaped projections 18*a,* 18*b* may be formed by cutting the fittable member 11 in positions in the vicinity of the opposite ends thereof and inwardly bending the sides of cut portions backward with respect to an insertion direction of the male terminal portion. Alternatively, there may be formed projections 19*a,* 19*b* by bending the leading end of the tongue-shaped projections at an angle as shown in FIG. 14.

Figure 15:
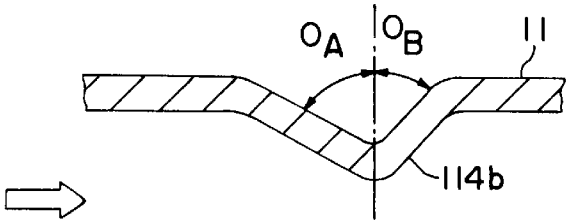
FIG. 15 is an enlarged front view partly in section of a part of still another embodiment of the invention.

Furthermore, as shown in FIG. 15, the projections 114*a,* 114*b* may be formed such that an angle of inclination θA of the projection 114*b* (114*a*) at a front side with respect to the insertion direction of the male terminal portion indicated by an arrow in FIG. 15 in its horizontal section is, e.g. 45° or larger and that an angle of inclination θB thereof at a rear side with respect to the insertion direction is, e.g. 45° or smaller. This makes the insertion of the male terminal portion 17 easier and more securely prevents the male terminal portion 17 from coming out.

Further, only a single through hole may be formed in the part insertion portion 1*a* and only a signal projection may be formed on the fittable member 11.

LIST OF REFERENCE NUMERALS

1 . . . Terminal Main Body

2 . . . Connection Part

2*a* . . . Part Main Body

2*b* . . . Insertion Hole (Female Terminal Portion)

7 . . . Connection Pin (Holding Member)

11 . . . Fittable Member

13 . . . Groove

13*a,*13*b* . . . Through Hole

14*a,*14*b* . . . Through Hole

114*a,*114*b,*18*a,*18*b,*19*a,*19*b* . . . Projection

16 . . . High-Voltage Part

16*a,*16*b* . . . Projection

17 . . . Male Terminal Portion

K . . . High-Voltage Resistive Cable

What is claimed is:

1. A connection device for connecting a cable, in particular a high-voltage resistive cable used for an internal combustion engine with a high-voltage part, comprising:

a terminal main body (1) having opposed ends, a substantially tubular part insertion portion (1*a*) being defined at one said end, a pair of through holes (14*a,* 14*b*) being formed through the part insertion portion (1*a*);

an electrical connection part (2) having a circumferentially extending locking groove (13) formed thereon, said electrical connection part (2), including the locking groove (13) thereof, being at least partially inserted into the substantially tubular part insertion portion (1*a*) of the terminal main body (1), and a fittable member (11) having a split-tubular portion with opposed axial ends and opposed inwardly and outwardly facing circumferential surfaces extending between said axial ends, said split-tubular portion being characterized by a longitudinal split defining a pair of substantially parallel edges extending between the opposed axial ends, said inwardly facing circumferential surface of said split-tubular portion being fitted on the part insertion portion (1*a*), a pair of tongue-shaped projections (16*a,* 16*b*) being formed on the fittable member (11), each said tongue-shaped projection (16*a,* 16*b*) being unitary with said split-tubular portion and being articulated inwardly from said split-tubular portion about a bend line extending parallel to the axial ends of the split-tubular portion, each said tongue-shaped projection having a pair of parallel side edges aligned orthogonally to said bend line and projecting inwardly from said bend line and an inner edge extending between the side edges, each said tongue-shaped projection (16*a,* 16*b*) projecting through one said through hole (14*a,* 14*b*) of said part insertion portion (1*a*) of the terminal main body (1), the inner edge of each said tongue-shaped projection (16*a,* 16*b*) being fitted in the locking groove (13) of the electrical connection part (2), thereby preventing the electrical connection part (2) from coming out of the part insertion portion (1*a*).

2. A connection device according to claim 1, wherein the electrical connection part (2; 17) comprises means for engagement with a male terminal portion (17) of a high-voltage part (16).

3. A connecting device according to claim 2, wherein the means for engagement comprises a female terminal portion (2*b*) formed at one end surface of the connection part (2) and the male terminal portion is insertable into the female portion.

4. A connection device according to claim 1, wherein the fittable member (11) is dimensioned such that the split-tubular portion thereof exerts inwardly acting restoring forces on the part insertion portion (1*a*) of the terminal main body (1).

5. A connector device according to claim 4, wherein the split-tubular portion of said fittable member (11) extends through more than 180°, said tongue-shaped projections (16*a,* 16*b*) being in proximity to the respective edges of the split-tubular portion and being separated from one another by more than 180°, such that the inwardly acting restoring forces urge the tongue-shaped projections (16*a,* 16*b*) into the locking groove (13) of the electrical connection part (11).

6. A connector device according to claim 1, wherein the groove (13) is of substantially rectangular cross-sectional shape.

7. A connection device according to claim 6, wherein the inner edge of each said tongue-shaped projection (16*a,* 16*b*) is substantially linear and is aligned substantially parallel to the axial ends of the C-shaped portion of the fittable member (11).

* * * * *